US006886704B2

(12) United States Patent
Hayes et al.

(10) Patent No.: US 6,886,704 B2
(45) Date of Patent: May 3, 2005

(54) CONTAINERS AND CONTAINER ASSEMBLIES WITH RELEASABLE LOCKING FEATURE

(75) Inventors: Thomas J. Hayes, McHenry, IL (US); Scott D. Brown, Winthrop Harbor, IL (US)

(73) Assignee: Pactiv Corporation, Lake Forest, IL (US)

( * ) Notice: Subject to any disclaimer, the term of this patent is extended or adjusted under 35 U.S.C. 154(b) by 9 days.

(21) Appl. No.: 10/277,303

(22) Filed: Oct. 22, 2002

(65) Prior Publication Data

US 2004/0074902 A1 Apr. 22, 2004

(51) Int. Cl.[7] ..... B65D 6/28

(52) U.S. Cl. ..... 220/4.24; 220/4.26; 206/508; 206/509; 206/515

(58) Field of Search ..... 220/4.24, 4.26, 220/4.23, 4.22, 4.25, 4.21; 206/508, 509, 515

(56) References Cited

U.S. PATENT DOCUMENTS

| | | | |
|---|---|---|---|
| 2,260,651 | A | 10/1941 | Annen |
| 2,720,332 | A | 10/1955 | Holt |
| 2,738,915 | A | 3/1956 | St. Clair |
| 2,798,631 | A | 7/1957 | Engel |
| 2,986,300 | A | 5/1961 | Parrish |
| 2,999,611 | A | 9/1961 | Paulson |
| 3,007,602 | A | 11/1961 | Frank |
| 3,049,259 | A | 8/1962 | Mazzi et al. |
| 3,459,356 | A | 8/1969 | Sparks |
| 3,520,440 | A | 7/1970 | Kinnavy et al. |
| 3,565,146 | A | 2/1971 | Arnolds |
| 3,572,413 | A | 3/1971 | Livingstone |

(Continued)

FOREIGN PATENT DOCUMENTS

| | | |
|---|---|---|
| BE | 740346 | 10/1969 |
| DE | DT 2349382 | 4/1975 |
| JP | 48-7205 | 2/1973 |
| JP | 51-81203 | 6/1976 |
| JP | 58-3456 | 1/1983 |
| JP | 59-11852 | 4/1984 |
| JP | 63-34069 | 3/1988 |
| JP | 63-62315 | 4/1988 |
| JP | 64-20462 | 2/1989 |
| JP | 2269665 | 11/1990 |
| JP | 8053148 | 2/1996 |
| JP | 11059711 | 3/1999 |
| JP | 2001002045 | 1/2001 |
| JP | 2002166951 | 6/2002 |

OTHER PUBLICATIONS

English translation of Belgian Patent No. 740,346 dated Oct. 16, 1969 (8 pages).

*Primary Examiner*—Joseph Man-Fu Moy
(74) *Attorney, Agent, or Firm*—Jenkens & Gilchrist

(57) ABSTRACT

A container assembly comprises a first container and a second container. The first container includes a first continuous body portion and a first rim. The rim has a first plurality of ribs projecting generally upwardly therefrom such that first spaces are formed between adjacent ribs. The second container includes a second continuous body portion and a second rim. The rim has a second plurality of ribs projecting generally upwardly therefrom such that second spaces are formed between adjacent ribs. The second rim and the first rim are shaped substantially the same. The first container and the second container are adapted to be releasably lockable to each other by fitting the first plurality of upwardly-projecting ribs into respective second spaces and fitting the second plurality of upwardly-projecting ribs into respective first spaces. The first container may be shaped substantially the same as the second container.

121 Claims, 8 Drawing Sheets

U.S. PATENT DOCUMENTS 3,620,403 A 11/1971 Rump
3,664,538 A 5/1972 Fioretti
3,902,540 A 9/1975 Commisso
3,933,295 A 1/1976 Congleton
3,938,726 A 2/1976 Holden, Jr. et al.
3,938,727 A 2/1976 Andersson
3,982,651 A 9/1976 Braun et al.
4,014,450 A 3/1977 Girotti et al.
4,114,668 A 9/1978 Hickey
4,124,141 A 11/1978 Armentrout et al.
4,149,578 A 4/1979 Hickey
4,171,062 A 10/1979 Allen et al.
4,180,179 A 12/1979 Hoenig et al.
4,195,746 A 4/1980 Cottrell
4,201,301 A 5/1980 Aggio
4,201,311 A 5/1980 Underwood
4,216,763 A * 8/1980 Miklas ..... 126/275 R
4,238,047 A 12/1980 Helms et al.
4,266,689 A 5/1981 Asher
4,294,371 A 10/1981 Davis
4,307,817 A 12/1981 Cotroneo
4,334,631 A 6/1982 Ballester
4,350,263 A 9/1982 Hoffman
4,360,118 A 11/1982 Stern
4,362,265 A 12/1982 Williams
4,378,895 A 4/1983 Woinarski
4,388,998 A 6/1983 Underwood et al. ..... 220/307
4,394,922 A 7/1983 Wimmer ..... 215/300
4,397,404 A 8/1983 Blanchette ..... 220/306
4,446,986 A 5/1984 Bowen et al. ..... 220/307
4,457,432 A 7/1984 Solheim ..... 206/503
4,458,825 A 7/1984 Holota ..... 220/307
4,487,326 A 12/1984 Uhlig ..... 215/307
4,520,943 A 6/1985 Nielsen ..... 220/281
4,524,882 A 6/1985 Buc ..... 220/306
4,555,043 A 11/1985 Bernhardt ..... 220/306
4,664,254 A 5/1987 Sitwell et al. ..... 206/1.7
4,741,434 A 5/1988 Liebman ..... 206/38
4,765,500 A 8/1988 Ingram ..... 220/4
4,811,550 A 3/1989 Hautemont ..... 53/478
4,819,824 A 4/1989 Longbottom et al. ..... 220/266
4,838,444 A 6/1989 Bitel ..... 220/4
4,854,472 A 8/1989 Semersky ..... 220/306
4,856,707 A 8/1989 Lorenz
4,878,595 A 11/1989 Uhlig ..... 220/306
4,890,740 A 1/1990 Tabler ..... 206/509
4,930,636 A 6/1990 Meadows ..... 206/503
4,971,774 A 11/1990 Schwanke et al. ..... 422/310
4,974,738 A 12/1990 Kidd et al.
5,036,980 A 8/1991 Vigue et al. ..... 206/515
5,042,674 A 8/1991 Ramsay et al. ..... 220/4.24
5,060,851 A 10/1991 Lorenz
5,069,354 A 12/1991 Tannenbaum ..... 220/4.22
5,097,977 A 3/1992 Straub ..... 220/307
5,161,711 A 11/1992 Picozza et al. ..... 220/282
5,170,905 A 12/1992 Luch ..... 220/276
5,181,626 A 1/1993 Daenen et al. ..... 220/282
D339,741 S 9/1993 Lorenz
5,265,749 A 11/1993 Zutler ..... 220/4.24
5,273,174 A 12/1993 Fisher
5,303,839 A 4/1994 Blumenschein ..... 220/306
5,310,070 A 5/1994 Haas et al. ..... 220/4.24
5,332,114 A 7/1994 Sano et al. ..... 220/4.24
5,356,023 A 10/1994 Krupa ..... 220/4.24
5,377,860 A 1/1995 Littlejohn et al. ..... 220/306
5,379,934 A 1/1995 Lorenz
5,388,714 A 2/1995 Zutler ..... 220/4.24
5,390,807 A 2/1995 Galaburda ..... 220/4.24
5,437,386 A 8/1995 Von Holdt ..... 220/306
5,437,388 A 8/1995 Bartelt et al.
5,605,231 A 2/1997 Borsboom et al. ..... 206/551
5,634,559 A 6/1997 Foos et al. ..... 206/518
5,666,875 A 9/1997 Wener ..... 99/422
5,785,203 A 7/1998 Arshinoff et al. ..... 220/783
5,875,918 A 3/1999 Sheffler ..... 220/783
5,979,687 A * 11/1999 Hayes et al. ..... 220/4.23
5,992,679 A 11/1999 Porchia et al. ..... 220/782
6,021,917 A 2/2000 Lovell et al. ..... 220/782
6,029,803 A 2/2000 Ovadia et al.
6,250,494 B1 6/2001 Diamond ..... 220/783
6,260,723 B1 7/2001 Bergholtz ..... 215/344
6,491,185 B1 12/2002 Azzarello et al. ..... 220/783
2002/0175164 A1 11/2002 Dees et al.
2003/0057207 A1 3/2003 Wong

* cited by examiner

CONTAINERS AND CONTAINER ASSEMBLIES WITH RELEASABLE LOCKING FEATURE

FIELD OF INVENTION

The present invention relates generally to containers. More particularly, the present invention relates to releasably lockable container assemblies and containers therein.

BACKGROUND OF THE INVENTION

The use of inexpensive polymeric, paper or metal packaging containers has become popular, especially for preparing and serving various food products. Polymeric, paper and metal containers generally have been used for heating the food product(s) disposed therein. These containers typically comprise a cover or lid and a base.

It would be desirable to have a container that would be easy for the customer to close and open. It would also be desirable to provide a container that is releasably lockable and prevents or inhibits material, such as liquid, from leaving the container. It would be desirable for a container to function without necessarily having a lid, but if a lid is desired to form a container assembly, a customer would be able to make such an assembly.

It would also be desirable to provide a container that is easy to manufacture and reduces the inventory requirement of customers that purchase the containers. It would also be desirable to produce a container that stacks efficiently so as to reduce the costs associated with shipping and storing the containers.

SUMMARY OF THE INVENTION

According to one embodiment, a container assembly comprises a first container and a second container. The first container includes a first continuous body portion and a first rim. The first rim encompasses and projects laterally outwardly from the first body portion. The rim has a first plurality of ribs projecting generally upwardly therefrom such that first spaces are formed between adjacent ribs. The second container includes a second continuous body portion and a second rim. The second rim encompasses and projects laterally outwardly from the second body portion. The rim has a second plurality of ribs projecting generally upwardly therefrom such that second spaces are formed between adjacent ribs. The first container is shaped substantially the same as the second container. The first container and the second container are adapted to be releasably lockable to each other by fitting the first plurality of upwardly-projecting ribs into respective second spaces and fitting the second plurality of upwardly-projecting ribs into respective first spaces.

According to one process, a container assembly is formed that comprises providing a first container that includes a first continuous body portion and a first rim. The first rim encompasses and projects laterally outwardly from the first body portion. The rim has a first plurality of ribs projecting generally upwardly therefrom such that first spaces are formed between adjacent ribs. A second container is provided that includes a second continuous body portion and a second rim. The second rim encompasses and projects laterally outwardly from the second body portion. The rim has a second plurality of ribs projecting generally upwardly therefrom such that second spaces are formed between adjacent ribs. The first container is shaped substantially the same as the second container. One of the first container and the second container is flipped such that the first container and second container are generally aligned and the first rim and the second rim are adjacent to each other. The first plurality of upwardly-projecting ribs is fit into respective second spaces and the second plurality of upwardly-projecting ribs is fit into respective first spaces such that the first container and the second container are releasably lockable to each other.

According to another embodiment, a container assembly comprises a first container and a second container. The first container includes a first continuous body portion and a first rim. The first rim encompasses and projects laterally outwardly from the first body portion. The rim has a first plurality of ribs projecting generally upwardly therefrom such that first spaces are formed between adjacent ribs. The second container includes a second continuous body portion and a second rim. The second rim encompasses and projects laterally outwardly from the second body portion. The rim has a second plurality of ribs projecting generally upwardly therefrom such that second spaces are formed between adjacent ribs. The second rim and the first rim are shaped substantially the same. The first container and the second container are adapted to be releasably lockable to each other by fitting the first plurality of upwardly-projecting ribs into respective second spaces and fitting the second plurality of upwardly-projecting ribs into respective first spaces.

According to another process, a container assembly is formed that comprises providing a first container that includes a first continuous body portion and a first rim. The first rim encompasses and projects laterally outwardly from the first body portion. The rim has a first plurality of ribs projecting generally upwardly therefrom such that first spaces are formed between adjacent ribs. A second container is provided that includes a second continuous body portion and a second rim. The second rim encompasses and projects laterally outwardly from the second body portion. The rim has a second plurality of ribs projecting generally upwardly therefrom such that second spaces are formed between adjacent ribs. The second rim and the first rim are shaped substantially the same. One of the first container and the second container is flipped such that the first container and second container are generally aligned and the first rim and the second rim are adjacent to each other. The first plurality of upwardly-projecting ribs is fit into respective second spaces and the second plurality of upwardly-projecting ribs is fit into respective first spaces such that the first container and the second container are releasably lockable to each other.

According to a further embodiment, a container assembly comprises a first and second container. The first container includes a first continuous body portion and a first rim. The first rim encompasses and projects laterally outwardly from the first body portion. The rim has a first plurality of upwardly projecting features with first spaces being formed between adjacent upwardly projecting features. The second container includes a second continuous body portion and a second rim. The second rim encompasses and projects laterally outwardly from the second body portion. The rim has a second plurality of upwardly projecting features with second spaces being formed between adjacent upwardly projecting features. The second rim and the first rim are shaped substantially the same. The first container and the second container are adapted to be releasably lockable to each other by fitting the first plurality of upwardly projecting features into respective second spaces and fitting the second plurality of upwardly projecting features into respective first spaces.

According to yet another embodiment, a container to be used in a container assembly comprises a continuous body portion and a rim. The rim encompasses and projects laterally outwardly from the body portion. The rim has a first plurality of ribs projecting generally upwardly therefrom such that first spaces are formed between adjacent ribs. The rim is adapted to be releasably lockable by fitting the first plurality of ribs and first spaces into respective second spaces and second plurality of ribs of a second container. The second spaces and the second plurality of ribs are shaped substantially the same as respective first spaces and first plurality of ribs.

According to yet a further embodiment, a container assembly comprises a first and second container. The first container includes a first continuous body portion and a first rim. The first rim encompasses and projects laterally outwardly from the first body portion. The rim has a first plurality of ribs projecting generally upwardly therefrom such that first spaces are formed between adjacent ribs. The second container includes a second continuous body portion and a second rim. The second rim encompasses and projects laterally outwardly from the second body portion. The rim has a second plurality of ribs projecting generally upwardly therefrom such that second spaces are formed between adjacent ribs. The first container is shaped substantially the same as the second container. The first container and the second container are adapted to be releasably lockable to each other by fitting the first plurality of upwardly-projecting ribs into respective second spaces and fitting the second plurality of upwardly-projecting ribs into respective first spaces. The first rim and the second rim are adapted to form a seal.

Figure 1:
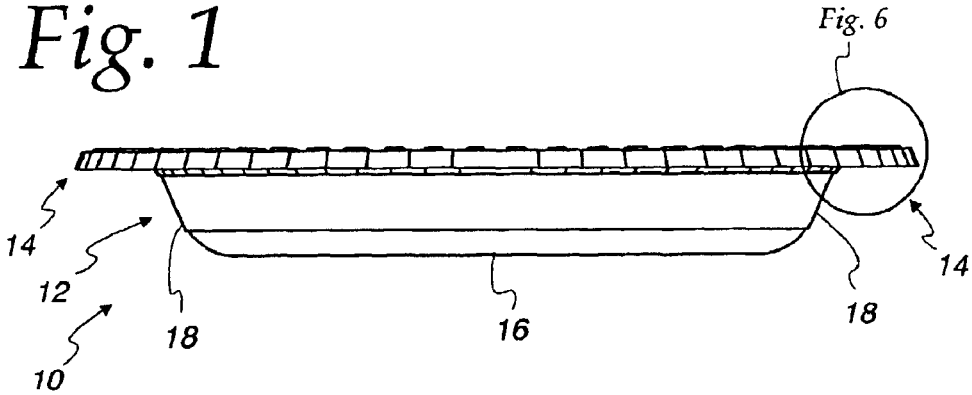
FIG. 1 is a side view of a container to be used in one embodiment of the invention.

While the invention is susceptible to various modifications and alternative forms, specific embodiments thereof have been shown by way of example in the drawing and will herein be described in detail. It should be understood, however, that it is not intended to limit the invention to the particular forms disclosed but, on the contrary, the intention is to cover all modifications, equivalents, and alternatives falling within the spirit and scope of the invention as defined by the appended claims.

DESCRIPTION OF ILLUSTRATIVE EMBODIMENTS

Referring to FIGS. 1–5, a container (e.g., plate 10) to be used in one embodiment of the present invention is shown. The plate 10 is used with a second plate 110 (see FIGS. 7 and 8) that may be substantially the same or, alternatively, identical to the plate 10 to form a container assembly that is releasably lockable.

It is contemplated that other container assemblies may be formed besides those using plates. For example, container assemblies may be formed, but are not limited to, using plates, bowls, platters, tubs, single-serve and family-size containers, single-serve and family-size ovenware, and combinations thereof. One such combination is a bowl and a plate that forms a container assembly. The remainder of the application will discuss container and container assemblies with respect to plates although it is recognized by one of ordinary skill in the art that other container assemblies, such as those discussed above, may be formed.

The height and shape of the container assembly may vary from that shown without departing from the scope of the invention. For example, the container assemblies of FIGS. 7*a* and 14*a*, as will be discussed, are depicted as being generally circular. It is contemplated that the container assemblies and containers used herein may be other shapes such as rectangular, square, hexagonal, octagonal, other polygonal shapes, or oval.

The container assemblies of the present invention are typically used with respect to food, but may be used in other applications such as with medical applications, cosmetics or other items. Food container assemblies may be used for serving, storing, preparing and/or re-heating the food.

Referring back to FIGS. 1–2, the container 10 includes a continuous body portion 12 and a continuous rim 14 encompassing and projecting laterally outwardly from the body portion 12. The body portion 12 includes a bottom 16 and a continuous sidewall 18 encompassing and projecting upwardly and outwardly from the bottom 16. It is contemplated that the sidewall may project only upwardly from the bottom 16 or even project upwardly and inwardly from the bottom 16. It is also contemplated that the rim may not be continuous, although it is preferred to be continuous.

Figure 2:
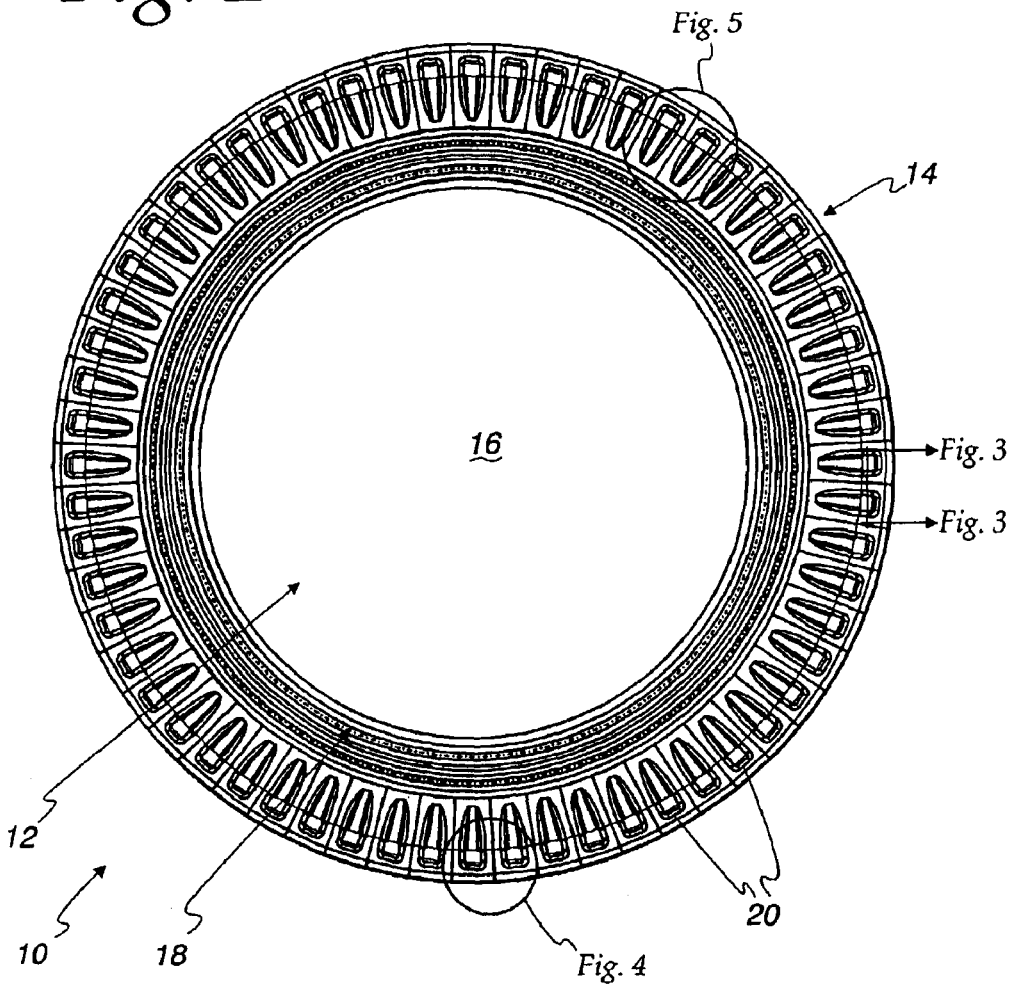
FIG. 2 is a top view of the container of FIG. 1.

Referring specifically to FIG. 2, the continuous rim 14 includes a plurality of ribs 20 that project generally upwardly therefrom. The plurality of ribs 20 is spaced around the general periphery of the container 10 and assists in forming a releasably lockable container assembly. The orientation of the plurality of ribs 20 creates a pattern that is generally normal to the direction of the rim 14. More specifically, the orientation of the plurality of ribs 20 may create a pattern that is normal to the direction of the rim 14. In a radial configuration with a pattern that is normal to the direction of the rim, each of the plurality of ribs 20, if extended inwardly, would pass through the general center of the plate.

The plurality of ribs 20, however, may be formed in different patterns than shown in FIG. 2 with respect to the rim 14 (e.g., diagonally). It may be desirable to form the plurality of ribs 20 in a decorative pattern for aesthetic reasons. Such a decorative feature may assist in "hiding" or disguising the releasable lockable feature in the container 10. The container 10 of FIG. 2 has exactly 60 ribs formed in the continuous rim 14. It is contemplated that the number of ribs may vary from that shown in FIG. 2. For example, a container may have from about 3 to about 10 ribs. A container may have greater than about 20 or about 40 ribs, and may even have up to or greater than about 120 ribs. The desired number of ribs formed on the container will often vary depending on factors such as the size or shape of the container assembly, the material(s) type and thicknesses of the container assembly, and the desired holding strength of the container assembly. The desired holding strength depends on factors such as the weight of item(s) placed in the container assembly and its perceived usage.

Figure 3:
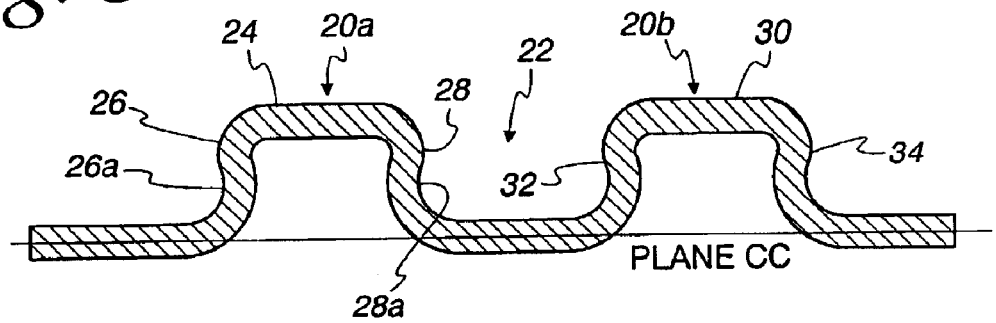
FIG. 3 is an enlarged cross-sectional view taken generally along lines FIG. 3—FIG. 3 in FIG. 2.
Figure 4:
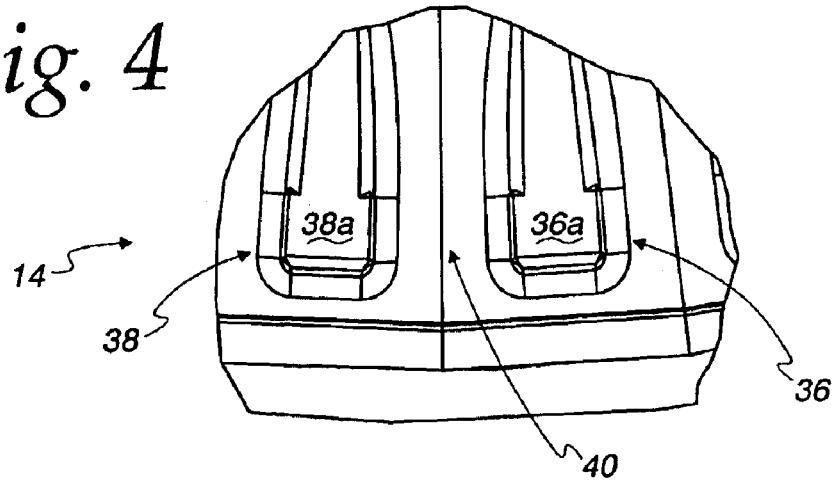
FIG. 4 is an enlarged top view of generally circular region FIG. 4 of FIG. 2.
Figure 5:
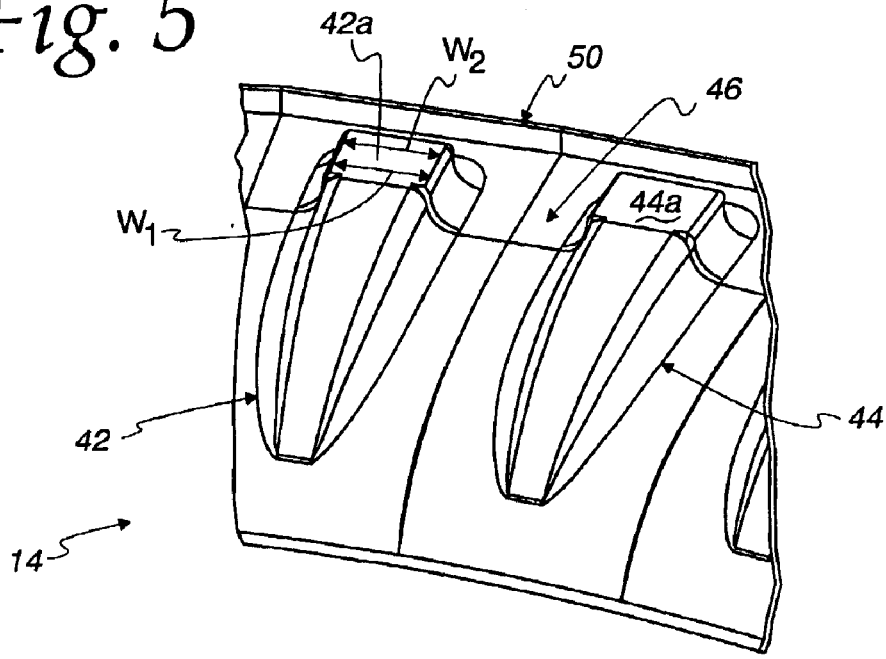
FIG. 5 is a perspective view of generally circular region FIG. 5 of FIG. 2 depicting two adjacent projecting ribs.

Turning to FIGS. 3–5, the plurality of ribs 20 is shown in greater detail. Specifically, a cross-sectional view of FIG. 3 shows two adjacent ribs that project upwardly from the continuous rim 14. FIG. 3 depicts a first rib 20*a* and a second rib 20*b* with a space 22 being formed therebetween. The first rib 20*a* of FIG. 3 comprises a generally flat surface 24 that bridges two sidewalls 26, 28. The first rib 20*a* is shown as being generally perpendicular to the plane of the remainder of the continuous rim 14. Specifically, the first rib 20*a* is shown as being generally perpendicular to plane CC formed along the remainder of the rim 14 in FIG. 3. More specifically, the rib may be perpendicular to the plane of the remainder of the rim. The sidewalls 26, 28 are spaced apart from each other and are shown as being generally perpendicular to the plane CC of the remainder of the rim 14. The sidewalls 26, 28, however, do not necessarily have to be generally perpendicular or perpendicular to the remainder of the rim 14.

Similarly, second rib 20*b* of FIG. 3 comprises a generally flat surface 30 that bridges two sidewalls 32, 34. The second rib 20*b* is also shown as being generally perpendicular to the plane CC of the remainder of the rim 14. The sidewalls 32, 34 are spaced apart from each other and are shown as being generally perpendicular to the plane CC of the remainder of the rim 14.

To provide an improved locked container assembly, at least one of the rib sidewalls may have an undercut. Such an optional undercut formed in the rib sidewall engages a similar undercut in a corresponding space formed between adjacent ribs of a second container when the container assembly is formed. This is discussed below in further detail with respect to FIGS. 7–8. For example, in FIG. 3, optional undercuts 26*a*, 28*a* are formed in respective sidewalls 26, 28. The size and shape of the undercut will often vary depending on factors such as the size or shape of the container assembly, the material(s) type and thicknesses of the container assembly, and the desired holding strength of the container assembly. The desired holding strength may depend on factors such as the weight of item(s) placed in the container assembly and its perceived usage.

The number of undercuts formed in the rib sidewalls, if any, depends on factors such as the desired leak-resistant, the type of closure mechanism, manufacturability of the container assemblies, and the material(s) type and thicknesses used in forming the container assemblies. For example, if the container assemblies are made of a first material that has a higher coefficient of friction than a second material, then the container made of the first material will likely need less undercuts in its sidewalls than the same container made with the second material to have the same holding strength. The number of undercuts used also depends on the fitness of use of the container assembly, including the holding strength thereof.

It is contemplated that the ribs may have sidewalls with no undercuts or at least one undercut (e.g., first rib 20*a* with optional undercuts 26*a*, 28*a* in FIG. 3). It is also contemplated that some ribs within the same container may have no undercuts, while other ribs may have one or more undercuts.

Referring to FIGS. 4 and 5, adjacent ribs 36, 38 of a portion of the rim 14 are shown in more detail. In FIG. 4, a top view of the ribs 36, 38 shows that the ribs 36, 38 generally taper inwardly toward the center of the container. FIG. 4 also shows a generally flat area 36*a* of rib 36 and a generally flat area 38*a* of rib 38. To improve the sealability of the container assembly, the generally flat areas 36*a*, 38*a* may contact similar sized flat areas formed in the respective spaces between adjacent ribs of a second container that form the container assembly. An example of a similar sized flat area formed in a space between adjacent ribs is shown in FIG. 4 with generally flat area 40.

FIG. 5 shows adjacent ribs 42, 44 with respective generally flat areas 42*a*, 44*a*. The ribs 42, 44 are spaced apart with a generally flat area 46 that is formed between generally flat areas 42*a*, 44*a*. To maintain clearances on radial designs (e.g., oval or circular shaped), the generally flat areas may grow proportionally with the diameter (i.e., increase in size as the distance increases from the center of the container). For example, in FIG. 5, the width W1 of generally flat area 42*a* may be smaller than width W2. With, for example, rectangular-shaped containers, the size of the generally flat areas typically remains constant as the distance increases from the center of the container. It is contemplated that this area of the ribs may be sized and shaped differently than shown in FIGS. 4 and 5.

It is contemplated that the shape and size of the plurality of ribs 20 may vary from that shown in FIGS. 2–5. It is preferred that the plurality of ribs be shaped and sized to minimize the stacking height of the containers used to form container assemblies. It is desirable to minimize the stacking height of the containers to (a) reduce transportation costs and packaging, and (b) provide space efficiency in retail and consumer settings. It is also desirable to maximize the holding strength of the container assembly. The desired holding strength is often a balance between making the container assembly easy for a consumer to open and close, while still preventing or inhibiting an inadvertent opening of the container assembly.

It is contemplated that the upwardly projecting features may be shaped differently than the ribs shown in FIGS. 2–5 and 11–13. For example, the upwardly projecting features may be a plurality of round, oval, square, or polygonal features. It is contemplated that many shapes and sizes may be formed by the upwardly projecting features used in the present invention.

Figure 6:
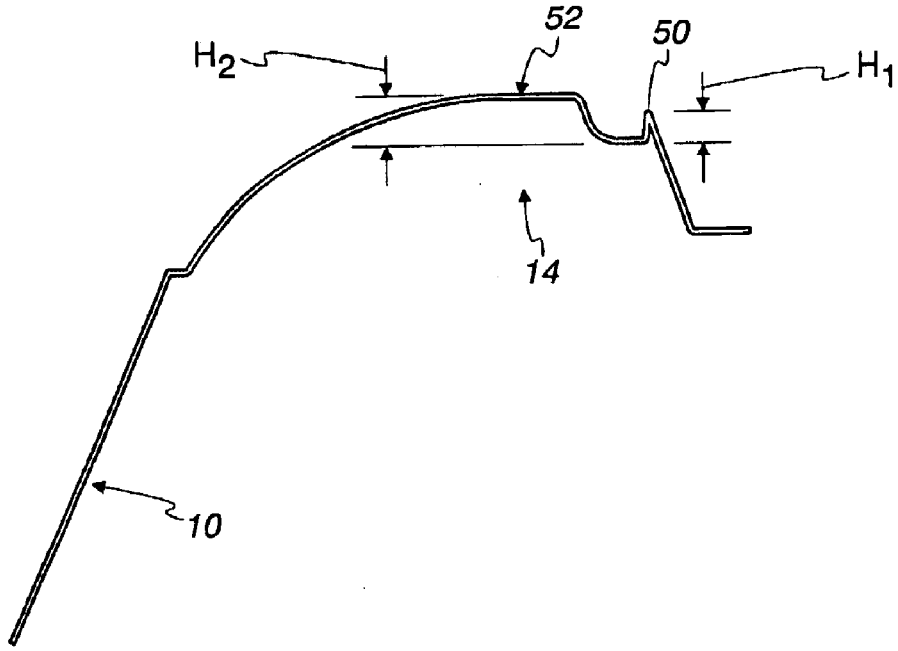
FIG. 6 is a sectional view of generally circular region FIG. 6 of FIG. 1 according to one embodiment.

Referring to FIGS. 5 and 6, an optional seal feature 50 formed on the rim 14 is depicted. In FIG. 6, the optional seal feature 50 is located outwardly from the rib 52 with respect to the center of the container 10. In other words, the optional seal feature 50 is located farther away from the center of the container 10 than the rib 52. The optional seal feature 50 in conjunction with a corresponding optional seal feature on another container (not shown), along with the locked ribs of the container assembly, assist in preventing or inhibiting material from leaving or entering the container assembly. The optional seal feature is especially useful in preventing or inhibiting product leakage that may occur due to tolerances within the manufacturing process. To provide an efficient seal, the height H1 of the optional seal feature 50 should be at least one-half of the rib height H2.

Figure 16B:
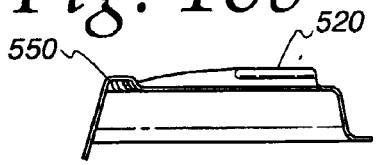
FIG. 16*b* is an enlarged cross-sectional view taken generally along lines FIG. 16*b*—FIG. 16*b* in FIG. 16*a.*
Figure 16A:
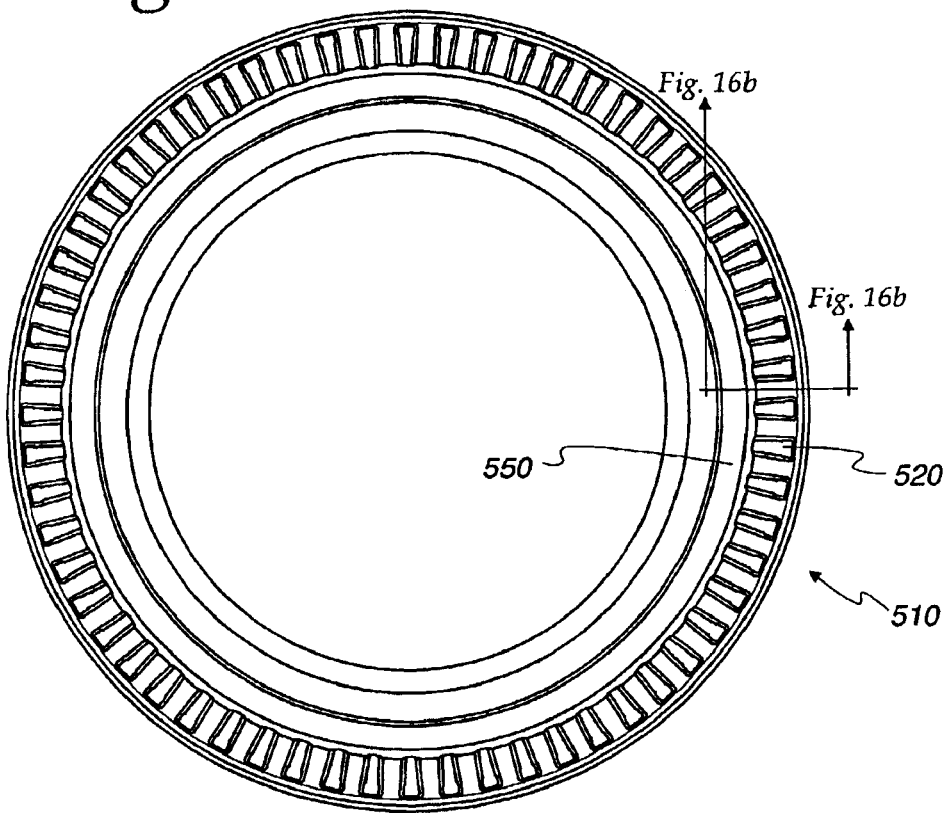
FIG. 16*a* is a top view of yet another container to be used in the present invention.

The optional seal feature, however, may be located inwardly from the ribs such that the seal is formed nearer the center of the container assembly as compared to the releasably lockable ribs. For example, in FIGS. 16*a* and 16*b*, a container 510 includes a plurality of ribs 520 and also includes an optional seal feature 550. In FIGS. 6 and 16*b*, the optional seal feature 550 is located inwardly from the plurality of ribs 520 with respect to the center of the container 510. The optional seal feature 550 in conjunction with a corresponding seal feature on another container (not shown), along with the locked ribs of the container assembly, assist in preventing or inhibiting material from leaving or entering the container assembly. The optional seal feature may be formed in a variety of shapes, including a general conical shape.

Figure 7A:
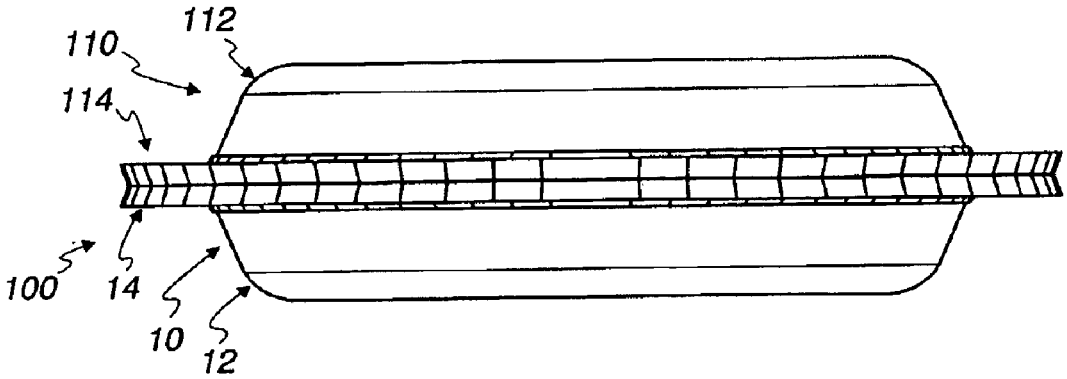
FIG. 7*a* is a side view of a container assembly in a releasably lockable position using the container of FIG. 1 and a second identical container of FIG. 1 according to one embodiment of the present invention.
Figure 7B:
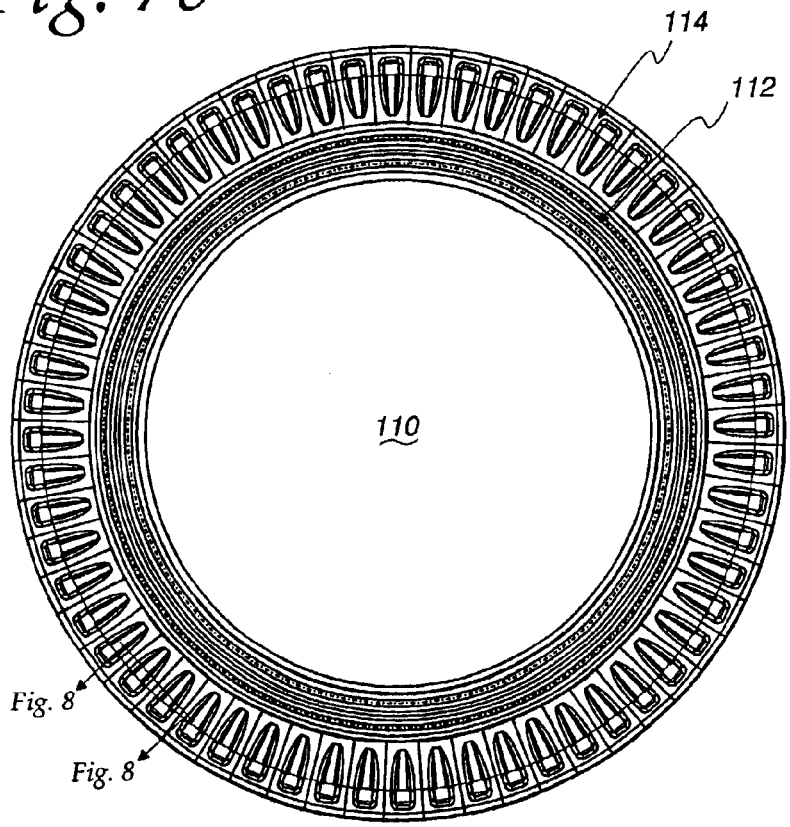
FIG. 7*b* is a top view of the container assembly of FIG. 7*a;*

A container assembly 100 according to one embodiment of the present invention is depicted in FIGS. 7*a*, 7*b*. The container 100 comprises the first container 10 and a second container 110. In one embodiment, the second container 110 is shaped substantially the same as the first container 10. Alternatively, the second container 110 may be identical to the first container 10. It may be desirable to have containers identically shaped to reduce waste by a consumer when the top container or lid is not used. As discussed above, the container assembly may be formed with different first and second containers than plates.

The container assembly 100 of FIGS. 7*a*, 7*b* may be formed according to one method by providing the first container 10 and the second container 110. The second container 110 includes a continuous body portion 112 and a continuous rim 114 that encompasses and projects laterally outwardly from the body portion 112. Similarly, the first container 10, as discussed above, includes the continuous body portion 12 and the continuous rim 14 that encompasses and projects laterally outwardly from the body portion 12. Both of the rims 14, 114 include a respective plurality of ribs with spaces therebetween (not shown in FIGS. 7*a*, 7*b*). Each of the plurality of ribs may be shaped and sized similarly to the ribs 20 shown above in FIGS. 2–5. Each of the plurality of ribs projects generally upwardly therefrom (i.e., in a direction away from the continuous body portion).

The second container 110 is flipped 180 degrees relative to the first container 10 such that the containers 10, 110 are generally aligned and the rims 14, 114 are adjacent to each other. This flipped position of container 110 relative to the container 10 is shown in FIG. 7*a*. To fit the ribs into respective spaces, the container 110 may have to be rotated slightly such that the ribs are offset (i.e., the ribs and spaces are aligned). It is desirable that the consumer can assembly the containers so as to form a container assembly of the present invention.

Figure 8:
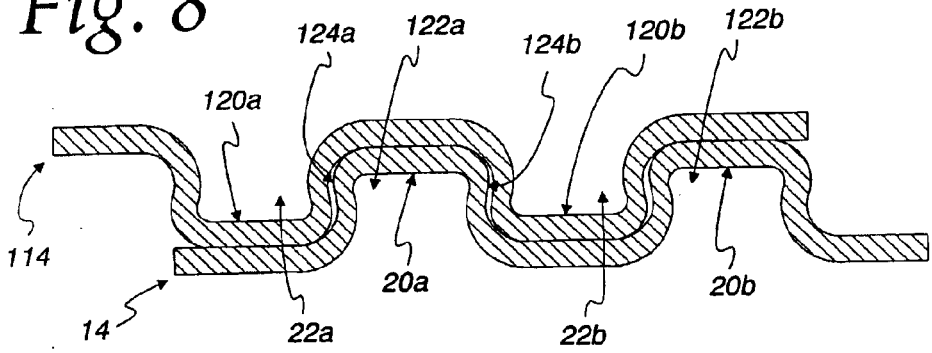
FIG. 8 is an enlarged cross-sectional view taken generally along lines FIG. 8—FIG. 8 in FIG. 7*b;*

Referring to FIG. 8, adjacent ribs 120*a*, 120*b* of the container 110 are fit into respective second spaces 22*a*, 22*b* of the container 10 and ribs 20*a*, 20*b* of the container 10 are fit into respective spaces 122*a*, 122*b* such that the container assembly 100 is releasably lockable. To fit the ribs into respective spaces, the container 110 may have to be rotated slightly such that the ribs are offset (i.e., the ribs and spaces are aligned). FIG. 8 also depicts interference areas 124*a*, 124*b* formed between the first rib 20*a* and the space 122*a* created between ribs 120*a*, 120*b* of the container 110.

The strength of this lockable closure is dependent on many variables such as the number of the projecting ribs, the height of those ribs, whether undercuts are included, the size of the contact areas, the clearance needed between spaces and ribs, and the material(s) type and thickness used in forming the container assemblies. To improve the lockability of the container assembly, as discussed above, an optional sealing feature may be added.

Figure 9:
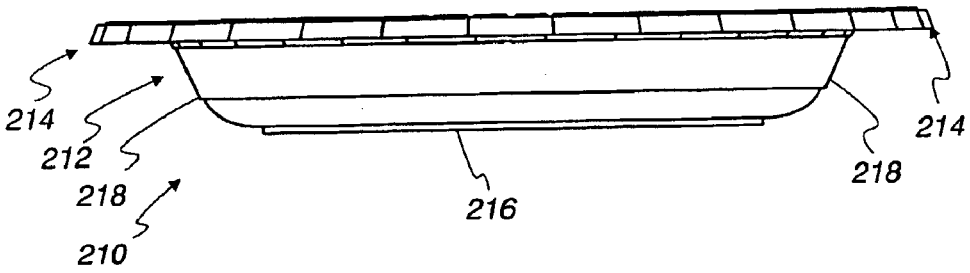
FIG. 9 is a side view of a container to be used in another embodiment of the invention.
Figure 10:
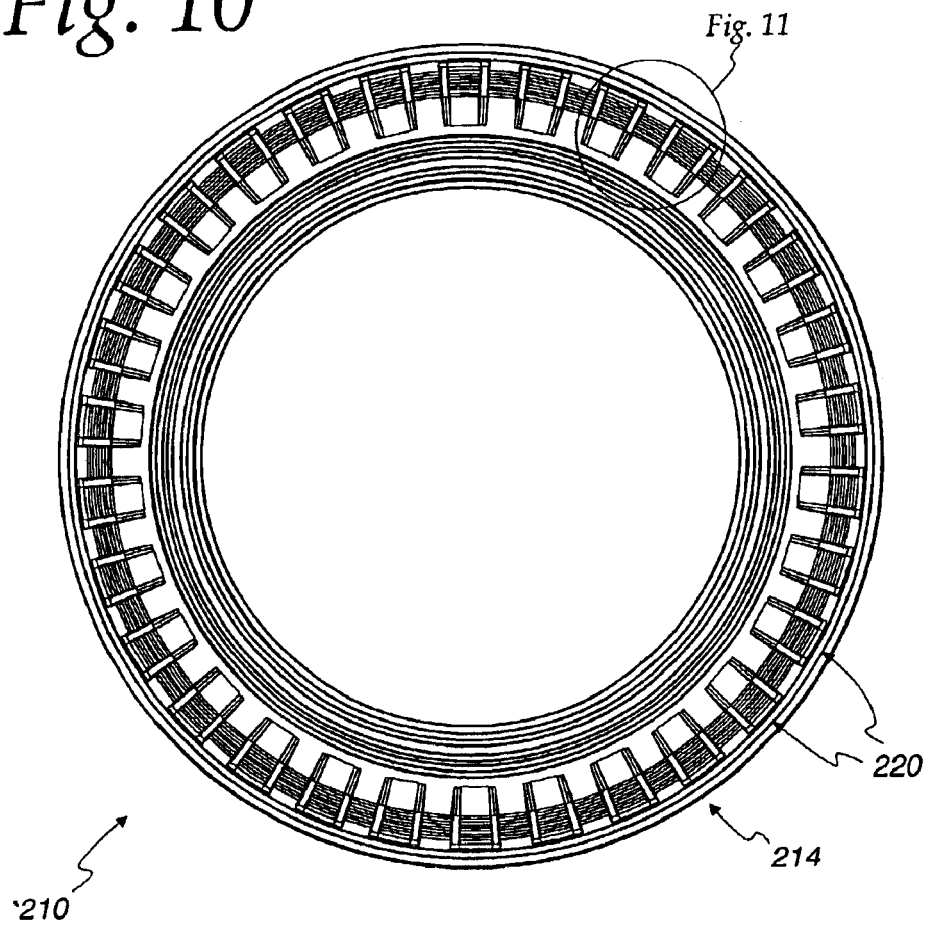
FIG. 10 is a top view of the container of FIG. 9.

Referring to FIGS. 9–10, a container (e.g., plate 210) includes a continuous body portion 212 and a continuous rim 214 encompassing and projecting laterally outwardly from the body portion 212. The body portion 212 includes a bottom 216 and a continuous sidewall 218 encompassing and projecting upwardly and outwardly from the bottom 216. It is contemplated that the sidewall may project only upwardly from the bottom 216 or even project upwardly and inwardly from the bottom 216. It is also contemplated that the rim may not be continuous, although it is preferred to be continuous.

Figure 11:
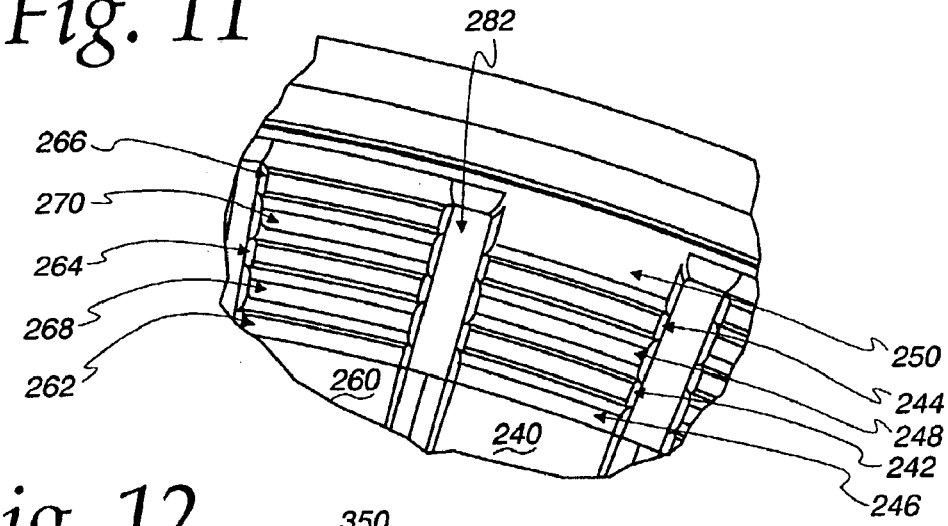
FIG. 11 is an enlarged top view of generally circular region FIG. 11 of FIG. 10.

Referring to FIGS. 10 and 11, the continuous rim 214 includes a plurality of rib sets 220 that project generally upwardly therefrom. The plurality of rib sets 220 is spaced around the general periphery of the container 210 and assists in forming a releasably lockable container assembly. The orientation of the plurality of rib sets 220 creates a pattern that is generally parallel or generally concentric with the general direction of the rim 214. In other words, each of the plurality of rib sets 220, if extended outwardly, would be no closer to the general center of the container 210. The plurality of rib sets 220 is in the opposite direction of the plurality of ribs 20 in FIGS. 2–5.

The plurality of rib sets 220, however, may be formed in different patterns than shown in FIG. 10 with respect to the rim 214 (e.g., diagonally). It may be desirable to form the plurality of rib sets 220 in a decorative pattern for aesthetic reasons. Such a decorative feature may assist in "hiding" or disguising the releasable lockable feature in the container 210.

The container 210 of FIG. 10 has exactly 60 sets of ribs formed in the continuous rim 214. As will be discussed in more detail below, each of the plurality of rib sets 220 has a first set of ribs on a raised portion and a second set of ribs on a recessed portion. It is contemplated that the number of rib sets may vary from that shown in FIG. 10. For example, a container may have from about 2 to about 30 sets of ribs. A container may have greater than about 40 or about 80 sets of ribs, and may even have up to or greater than about 120 sets of ribs. The desired number of ribs formed on the container will often vary depending on factors such as the size or shape of the container assembly, the material(s) type and thicknesses of the container assembly, and the desired holding strength of the container assembly. The desired holding strength may depend on factors such as the weight of item(s) placed in the container assembly and its perceived usage.

Figure 12:
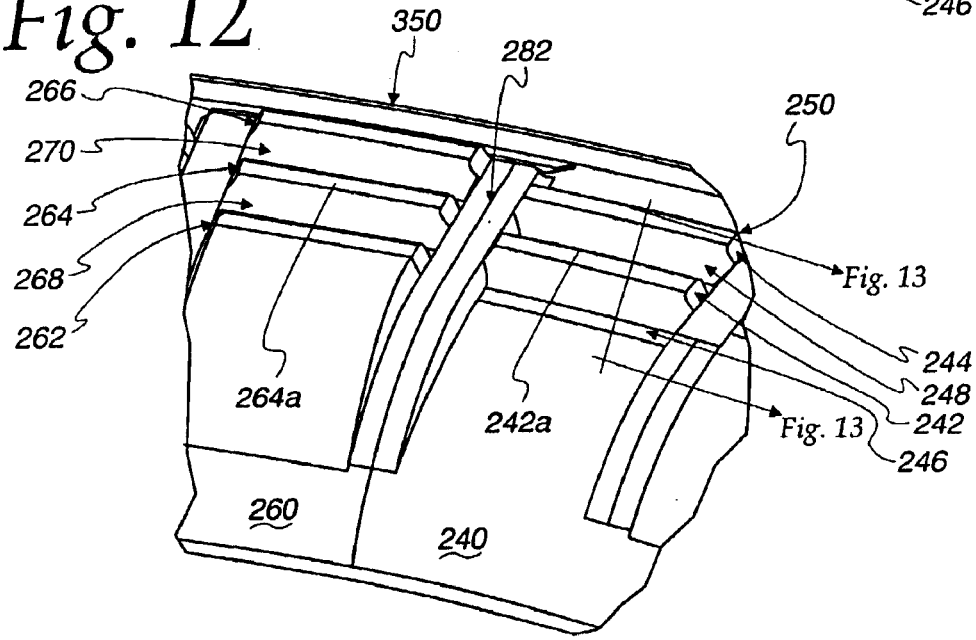
FIG. 12 is a perspective view of generally circular region FIG. 11 of FIG. 10 depicting two adjacent projecting ribs.
Figure 13:
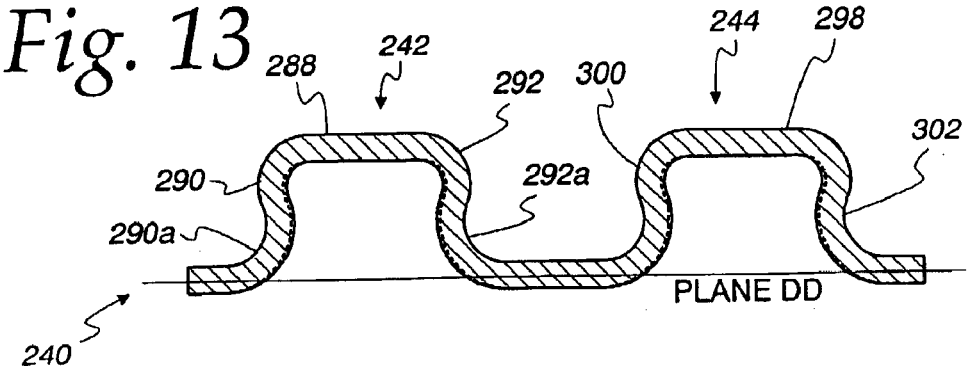
FIG. 13 is an enlarged cross-sectional view taken generally along lines FIG. 13—FIG. 13 in FIG. 12.

Turning to FIGS. 11–13, two adjacent sets of ribs are shown in greater detail. The number of ribs in a set varies in FIGS. 11 and 12 depending on whether the ribs are located in a recessed area or a raised area formed in the rim 214. For example, in FIGS. 11 and 12, recessed area 240 has a first rib 242 and a second rib 244 with spaces 246, 248 and 250. Raised area 260 of FIGS. 11 and 12, however, has a first rib 262, a second rib 264, and a third rib 266 with spaces 268, 270 therebetween. Each of the ribs of FIGS. 11 and 12 projects upwardly from the continuous rim 214.

Referring specifically to FIG. 13, a cross-sectional view of the recessed area 240 is depicted and includes the ribs 242, 244. A cross-sectional view of the raised area 260 (not shown) would depict three ribs. The first rib 242 of FIG. 13 comprises a generally flat surface 288 that bridges two sidewalls 290, 292. The first rib 242 is shown as being generally perpendicular to the plane of the remainder of the continuous rim 214. Specifically, the first rib 242 is shown as being generally perpendicular to plane DD formed along the remainder of the rim 214 in FIG. 13. More specifically, the rib may be perpendicular to the plane of the remainder of the rim. The sidewalls 290, 292 are spaced apart from each other and are shown as being generally perpendicular to the plane DD of the remainder of the rim 214. The sidewalls 290, 292, however, do not necessarily have to be generally perpendicular or perpendicular to the remainder of the rim 214.

Similarly, second rib 244 of FIG. 13 comprises a generally flat surface 298 that bridges two sidewalls 300, 302. The second rib 244 is also shown as being generally perpendicular to the plane DD of the remainder of the rim 214. The sidewalls 300, 302 are spaced apart from each other and are shown as being generally perpendicular to the plane DD of the remainder of the rim 214.

To provide an improved locked container assembly, at least one of the rib sidewalls may have an optional undercut. As discussed above, such an undercut formed in the rib sidewall engages a similar undercut in the spaces formed between adjacent ribs when the container assembly is formed. For example, in FIG. 13, optional undercuts 290*a*, 292*a* are formed in respective sidewalls 290, 292. The size and shape of the undercut will often vary depending on factors such as the size or shape of the container assembly, the material(s) type and thicknesses of the container assembly, and the desired holding strength of the container assembly. The desired holding strength may depend on factors such as the weight of item(s) placed in the container assembly and its perceived usage.

As discussed above, the number of undercuts formed in the rib sidewalls, if any, depends on several factors. It is contemplated that the ribs may have sidewalls with no undercuts or at least one undercut (e.g., first rib 242 with optional undercuts 290*a*, 292*a* in FIG. 13). It is also contemplated that some ribs within the same container may have no undercuts, while other ribs have one or more undercuts.

Referring back to FIG. 12, the raised and recessed areas 240, 260 have a plurality of ribs with generally flat areas. For example, the rib 242 includes a top surface or generally flat area 242*a*. Similarly, the rib 264 includes a top surface or generally flat area 264*a*. To improve the sealability of the container assembly, the generally flat areas 264*a*, 242*a* may contact similar sized flat areas formed in the spaces formed between adjacent ribs of a second container that forms the container assembly. An example of a similar sized flat area formed in a space is depicted in FIG. 12 with space 246. As shown in FIG. 12, a generally flat area 282 is formed between adjacent sets of ribs (i.e., the raised and recessed portions) to assist in releasably locking the container assembly. It is contemplated that this area of the ribs may be sized and shaped differently than shown in FIGS. 11–13. It is contemplated that the numbers of ribs in a set of ribs may vary from that shown in FIGS. 11 and 12 (two ribs in the recessed areas and three ribs in the raised areas)

It is contemplated that the shape and size of the plurality of ribs 220 may vary from that shown in FIGS. 10–13. It is preferred that the plurality of ribs be shaped and sized to minimize the stacking height of the containers. It is desirable to minimize the stacking height of the containers to (a) reduce transportation costs and packaging, and (b) provide space efficiency in retail and consumer settings. It is also desirable to maximize the holding strength of the container assembly. The desired holding strength is often a balance between making the container assembly easy for a consumer to open and close, while still preventing or inhibiting an inadvertent opening of the container assembly.

Figure 15:
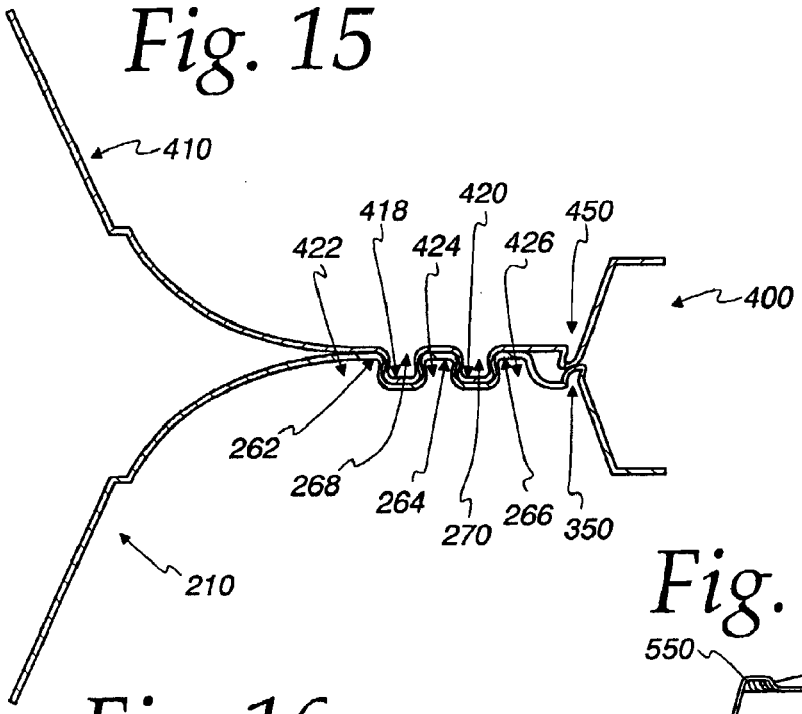
FIG. 15 is an enlarged cross-sectional view taken generally along lines FIG. 15—FIG. 15 in FIG. 14*b;*

Referring specifically to FIG. 12, an optional seal feature 350 formed on the rim 214 is depicted. The optional seal feature 350 is located outwardly from the ribs 242, 244, 262, 264 and 266 with respect to the center of the container 210. In other words, the optional seal feature 350 is located farther away from the center of the container 210 than the ribs. The optional seal feature 350 in conjunction with a corresponding seal feature on another container (e.g., optional seal feature 450 shown in FIG. 15), along with the locked ribs of the container assembly, assist in preventing or inhibiting material from leaving or entering the container assembly. The optional seal feature is especially useful in preventing or inhibiting product leakage that may occur due to tolerances within the manufacturing process. To provide an efficient seal, the height of the optional seal feature should be at least one-half of the rib height. This is shown in FIG. 15 where the optional seal features 350 and 450 contact each other.

As discussed above with respect to FIGS. 16*a, b* above, the optional seal feature, however, may be located inwardly from the ribs such that the seal is formed nearer the center of the container assembly as compared to the releasably lockable ribs.

Figure 14A:
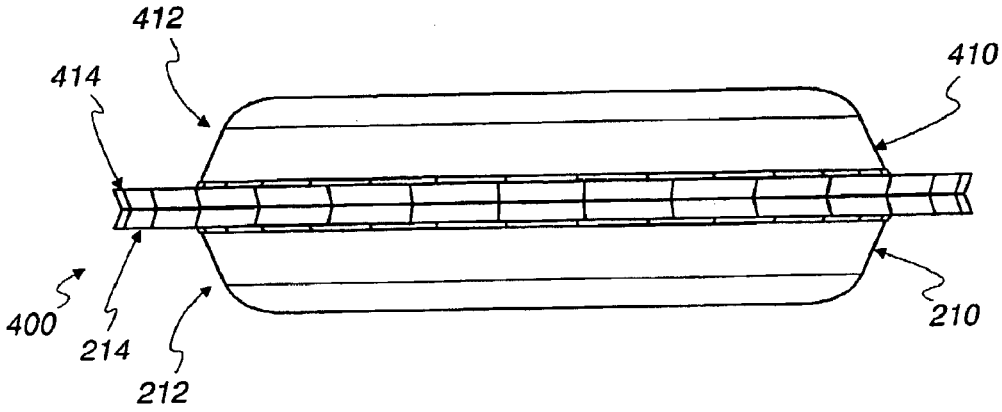
FIG. 14*a* is a side view of a container assembly in a releasably lockable position using the container of FIG. 9 and a second identical container of FIG. 9 according to another embodiment of the present invention.
Figure 14B:
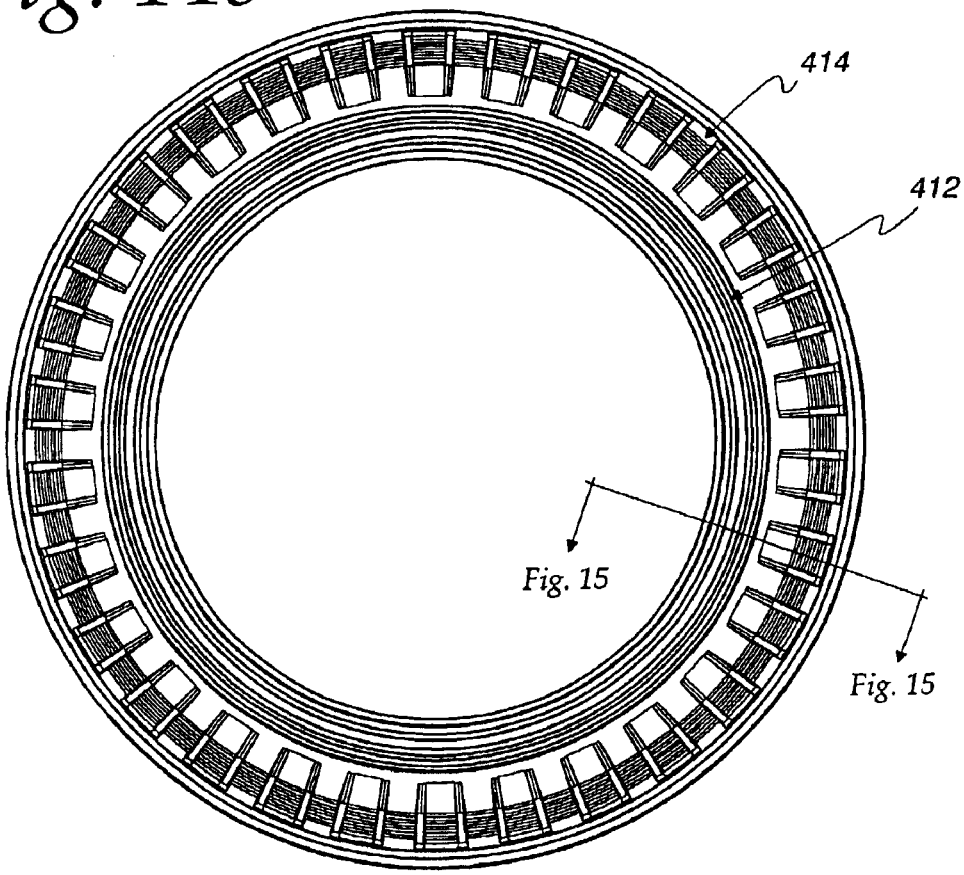
FIG. 14*b* is a top view of the container assembly of FIG. 14*a;*

A container assembly 400 according to one embodiment of the present invention is depicted in FIGS. 14*a*, 14*b*. The container 400 comprises the first container 210 and a second container 410. In one embodiment, the second container 410 is shaped substantially the same as the first container 210. Alternatively, the second container 410 may be identical to the first container 210. As discussed above, the container assembly may be formed with different first and second containers than plates. For example, the container assembly may be formed using a bowl and a plate.

The container assembly 400 of FIGS. 14*a*, 14*b* may be formed according to one method by providing the first container 210 and the second container 410. The second container 410 includes a continuous body portion 412 and a continuous rim 414 that encompasses and projects laterally outwardly from the body portion 412. Similarly, the first container 210, as discussed above, includes the continuous body portion 212 and the continuous rim 214 that encompasses and projects laterally outwardly from the body portion 212. Both of the rims 214, 414 include a respective plurality of ribs with spaces therebetween (not shown in FIGS. 14*a*, 14*b*). Each of the plurality of ribs may be shaped and sized similarly to the ribs 220 shown above in FIGS. 10–13. Each of the plurality of ribs projects generally upwardly therefrom (i.e., in a direction away from the continuous body portion).

As discussed above with container assembly 100, the second container 410 is flipped 180 degrees relative to the first container 210 such that the containers 210, 410 are generally aligned and the rims 214, 414 are adjacent to each other. This flipped position of the container 410 relative to the container 210 is shown in FIG. 14*a*.

Referring to FIG. 15, adjacent ribs 262, 264, 266 of one set of the container 210 are fit into respective second spaces 422, 424, and 426 of the container 410 and ribs 418, 420 of the container 410 are fit into respective spaces 268, 270 such that the container assembly 400 is releasably lockable.

The strength of this lockable closure is dependent on many variables such as the number of the projecting ribs, the height of those ribs, whether undercuts are included, the size of the contact areas, the clearance needed between spaces and ribs, and the material(s) type and thickness used in forming the container assemblies. To improve the lockability of the container assembly, as discussed above, an optional sealing feature may be added.

The container assemblies of the present invention are typically formed from polymeric materials, but may be formed from materials such as paper or metal. The polymeric containers may be formed from polyolefins. The polymeric food containers are typically formed from orientated polystyrene (OPS), polyethylene terephthalate (PET), polyvinyl chloride (PVC), polypropylene and combinations thereof. The containers assemblies may be made from a mineral-filled polymeric material such as, for example, talc or calcium carbonate-filled polyolefin. An example of paper that may be used in forming the container assemblies is paperboard or molded fiber. Paperboard and molded fiber typically have a sufficient coefficient of friction to maintain the first and second containers in a lockable position.

As discussed, the materials used in forming the container assembly may assist in releasably locking the container assembly. For example, the material(s) forming the container assembly may have a fairly tacky laminate on one side that corresponds with a fairly tacky laminate on the opposing side, resulting in a desirable releasably lockable container assembly.

It is contemplated that the containers used in forming the container assemblies may be made from different materials. It is contemplated that one of ordinary skill in the art will recognize that other polymers or combination of polymers may be used to form the containers.

The container assemblies of the present invention are typically disposable, but it is contemplated that they may be reused at a future time. The containers used in forming the container assemblies (e.g., container 10) are shown as including one compartment. It is contemplated that the containers may be formed of multiple compartments. Such containers are desirable for placing items (e.g., food items) in different compartments to prevent or inhibit commingling of items. For example, undesirable mixing of food items can corrupt the flavor and the consistency of the food items.

As discussed above, the container assemblies may be used with food items. A method of using such container assemblies includes placing the food and locking the containers to form a container assembly with food therein. The container assembly is then placed in a heating apparatus and heated. Typical heating apparatuses include microwaves and conventional ovens. The container assemblies may contain solid food products. The container assemblies may be used for storage in the refrigerator and/or the freezer.

The containers to be used in forming the container assemblies of the present invention may be formed using conventional thermoforming (e.g., by pressure, vacuum or the combination thereof), injection-molding processes, or rotational molding. According to one method of thermoforming, pellets of a polymeric resin and additives, if any, are added into an extruder. The pellets of the polymeric resin and additives, if any, are melted to form a blend. The blend is extruded through a die to form an extruded sheet. The extruded sheet is thermoformed to a desired shape of a container to be used in forming the container assembly.

The thickness of the container to be used in forming the container assemblies generally ranges from about 0.002 to about 0.15 inch, but is typically from about 0.005 to about 0.04 inch. The container assemblies may be opaque or a variety of colors or color combinations. The container assemblies typically have at least one transparent container if it is desired for the customer to ascertain the nature of the accommodated product and the condition thereof without having to open the container assembly.

While particular embodiments and applications of the present invention have been illustrated and described, it is to be understood that the invention is not limited to the precise construction and compositions disclosed herein and that various modifications, changes, and variations may be apparent from the foregoing descriptions without departing from the spirit and scope of the invention as defined in the appended claims.

What is claimed is:

1. A container assembly, comprising:

a first container including a first continuous body portion and a first rim, the first rim encompassing and projecting laterally outwardly from the first body portion, the rim having a first plurality of ribs projecting generally upwardly therefrom such that first spaces are formed between adjacent ribs, the first plurality of upwardly-projecting ribs creating a first pattern that is generally normal to the direction of the first rim; and a second container including a second continuous body portion and a second rim, the second rim encompassing and projecting laterally outwardly from the second body portion, the second rim having a second plurality of ribs projecting generally upwardly therefrom such that second spaces are formed between adjacent ribs, the second plurality of upwardly-projecting ribs creating a second pattern that is generally normal to the direction of the second rim, the first container being shaped substantially the same as the second container, wherein the first container and the second container are adapted to be releasably lockable to each other by fitting the first plurality of upwardly-projecting ribs into respective second spaces and fitting the second plurality of upwardly-projecting ribs into respective first spaces.

2. The container assembly of claim 1, wherein the first and second containers are bowls.

3. The container assembly of claim 1, wherein the first and second containers are plates.

4. The container assembly of claim 1, wherein the first container is a bowl and the second container is a plate.

5. The container assembly of claim 1, wherein the first and second containers are platters.

6. The container assembly of claim 1, wherein the first and second containers are made of polymeric material.

7. The container assembly of claim 6, wherein the first and second containers are made of a mineral-filled polymeric material.

8. The container assembly of claim 1, wherein at least one of the first and second containers are paper or metal.

9. The container assembly of claim 1, wherein the first container is identical to the second container.

10. The container assembly of claim 1, wherein the first plurality of upwardly-projecting ribs and the second plurality of upwardly-projecting ribs are generally perpendicular to the plane of the remainder of the respective rims.

11. The container assembly of claim 10, wherein the first plurality of upwardly-projecting ribs and the second plurality of upwardly-projecting ribs are perpendicular to the plane of the remainder of the respective rims.

12. The container assembly of claim 1, wherein the first plurality of upwardly-projecting ribs comprises first and second sidewalls spaced apart that are each generally perpendicular to the plane of the remainder of the first rim and a generally first flat surface that encompasses and bridges the first and second sidewalls, and wherein the second plurality of upwardly-projecting ribs comprises third and fourth sidewalls spaced part that are each generally perpendicular to the plane of the remainder of the second rim and generally second flat surface that encompasses and bridges the third and fourth sidewalls.

13. The container assembly of claim 1, wherein the first plurality of upwardly-projecting ribs comprises first and second sidewalls and a surface that encompasses and bridges the first and second sidewalls, at least one of the first and second sidewalls has a first undercut, and wherein the second plurality of upwardly-projecting ribs comprises third and fourth sidewalls and a surface that encompasses and bridges the third and fourth sidewalls, at least one of the third and fourth sidewalls has a second undercut.

14. The container assembly of claim 1, wherein the first plurality of upwardly-projecting ribs creates a first pattern that is generally normal to the direction of the first rim, and the second plurality of upwardly-projecting ribs creates a second pattern that is generally normal to the direction of the second rim.

15. The container assembly of claim 1, wherein the first plurality of upwardly-projecting ribs creates a first pattern that is normal to the direction of the first rim, and the second plurality of upwardly-projecting ribs creates a second pattern that is normal to the direction of the second rim.

16. The container assembly of claim 1, wherein each of the first plurality of upwardly-projecting ribs is generally concentric with the center of the first container and each of the second plurality of upwardly-projecting ribs is generally concentric with the center of the second container.

17. The container assembly of claim 1, wherein each of the first plurality of upwardly-projecting ribs and the second plurality of upwardly-projecting ribs includes at least about 3 ribs.

18. The container assembly of claim 17, wherein each of the first plurality of upwardly-projecting ribs and the second plurality of upwardly-projecting ribs includes at least about 40 ribs.

19. The container assembly of claim 1, wherein the first rim and the second rim are adapted to form a seal.

20. The container assembly of claim 19, wherein the seal is located outwardly from the first plurality of upwardly-projecting ribs and the second plurality of upwardly-projecting ribs.

21. The container assembly of claim 19, wherein the seal is located inwardly from the first plurality of upwardly-projecting ribs and the second plurality of upwardly-projecting ribs.

22. The container assembly of claim 1, wherein each of the first plurality of upwardly-projecting ribs and the second plurality of upwardly-projecting ribs includes at least about 2 sets of ribs.

23. The container assembly of claim 1, wherein the first and second container are thermoformed.

24. A container assembly, comprising:

a first container including a first continuous body portion and a first rim, the first rim encompassing and projecting laterally outwardly from the first body portion, the rim having a first plurality of ribs projecting generally upwardly therefrom such that first spaces are formed between adjacent ribs, the first plurality of upwardly-projecting ribs creating a first pattern that is generally normal to the direction of the first rim; and a second container including a second continuous body portion and a second rim, the second rim encompassing and projecting laterally outwardly from the second body portion, the second rim having a second plurality of ribs projecting generally upwardly therefrom such that second spaces are formed between adjacent ribs, the second plurality of upwardly-projecting ribs creating a second pattern that is generally normal to the direction of the second rim, the second rim and the first rim being shaped substantially the same, wherein the first container and the second container are adapted to be releasably lockable to each other by fitting the first plurality of upwardly-projecting ribs into respective second spaces and fitting the second plurality of upwardly-projecting ribs into respective first spaces.

25. The container assembly of claim 24, wherein the first and second containers are bowls.

26. The container assembly of claim 24, wherein the first and second containers are plates.

27. The container assembly of claim 24, wherein the first container is a bowl and the second container is a plate.

28. The container assembly of claim 24, wherein the first and second containers are platters.

29. The container assembly of claim 24, wherein the first and second containers are made of polymeric material.

30. The container assembly of claim 29, wherein the first and second containers are made of a mineral-filled polymeric material.

31. The container assembly of claim 24, wherein at least one of the first and second containers are paper or metal.

32. The container assembly of claim 24, wherein the first rim is identical to the second rim.

33. The container assembly of claim 24, wherein the first plurality of upwardly-projecting ribs and the second plurality of upwardly-projecting ribs are generally perpendicular to the plane of the remainder of the respective rims.

34. The container assembly of claim 33, wherein the first plurality of upwardly-projecting ribs and the second plurality of upwardly-projecting ribs are perpendicular to the plane of the remainder of the respective rims.

35. The container assembly of claim 24, wherein the first plurality of upwardly-projecting ribs comprises first and second sidewalls spaced apart that are each generally perpendicular to the plane of the remainder of the first rim and a generally first flat surface that encompasses and bridges the first and second sidewalls, and wherein the second plurality of upwardly-projecting ribs comprises third and fourth sidewalls spaced part that are each generally perpendicular to the plane of the remainder of the second rim and generally second flat surface that encompasses and bridges the third and fourth sidewalls.

36. The container assembly of claim 24, wherein the first plurality of upwardly-projecting ribs comprises first and second sidewalls and a surface that encompasses and bridges the first and second sidewalls, at least one of the first and second sidewalls has a first undercut, and wherein the second plurality of upwardly-projecting ribs comprises third and fourth sidewalls and a surface that encompasses and bridges the third and fourth sidewalls, at least one of the third and fourth sidewalls has a second undercut.

37. The container assembly of claim 24, wherein the first plurality of upwardly-projecting ribs creates a first pattern that is generally normal to the direction of the first rim, and the second plurality of upwardly-projecting ribs creates a second pattern that is generally normal to the direction of the second rim.

38. The container assembly of claim 24, wherein the first plurality of upwardly-projecting ribs creates a first pattern that is normal to the direction of the first rim, and the second plurality of upwardly-projecting ribs creates a second pattern that is normal to the direction of the second rim.

39. The container assembly of claim 24, wherein each of the first plurality of upwardly-projecting ribs and the second plurality of upwardly-projecting ribs includes at least about 3 ribs.

40. The container assembly of claim 39, wherein each of the first plurality of upwardly-projecting ribs and the second plurality of upwardly-projecting ribs includes at least about 40 ribs.

41. The container assembly of claim 24, wherein the first rim and the second rim are adapted to form a seal.

42. The container assembly of claim 41, wherein the seal is located outwardly from the first plurality of upwardly-projecting ribs and the second plurality of upwardly-projecting ribs.

43. The container assembly of claim 41, wherein the seal is located inwardly from the first plurality of upwardly-projecting ribs and the second plurality of upwardly-projecting ribs.

44. The container assembly of claim 24, wherein each of the first plurality of upwardly-projecting ribs and the second plurality of upwardly-projecting ribs includes at least about 2 sets of ribs.

45. The container assembly of claim 24, wherein the first and second container are thermoformed.

46. A container assembly, comprising:

a first container including a first continuous body portion and a first rim, the first rim encompassing and projecting laterally outwardly from the first body portion, the rim having a first plurality of upwardly-projecting features with first spaces being formed between adjacent upwardly-projecting features, the first plurality of upwardly-projecting features creating a first pattern that is generally normal to the direction of the first rim; and a second container including a second continuous body portion and a second rim, the second rim encompassing and projecting laterally outwardly from the second body portion, the second rim having a second plurality of upwardly-projecting features with second spaces being formed between adjacent upwardly-projecting features, the second plurality of upwardly-projecting features creating a second pattern that is generally normal to the direction of the second rim, the second rim and the first rim being shaped substantially the same, wherein the first container and the second container are adapted to be releasably lockable to each other by fitting the first plurality of upwardly-projecting features into respective second spaces and fitting the second plurality of upwardly-projecting features into respective first spaces.

47. The container assembly of claim 46, wherein the first container is shaped substantially the same as the second container.

48. The container assembly of claim 47, wherein the first container and the second container are identical.

49. The container assembly of claim 46, wherein the first and second rim are identical.

50. The container assembly of claim 46, wherein the first and second containers are made of polymeric material.

51. The container assembly of claim 46, wherein the first rim and the second rim are adapted to form a seal.

52. The container assembly of claim 51, wherein the seal is located outwardly from the first plurality of upwardly-projecting ribs and the second plurality of upwardly-projecting ribs.

53. The container assembly of claim 51, wherein the seal is located inwardly from the first plurality of upwardly-projecting ribs and the second plurality of upwardly-projecting ribs.

54. A container to be used in a container assembly, comprising a continuous body portion and a rim, the rim encompassing and projecting laterally outwardly from the body portion, the rim having a first plurality of ribs projecting generally upwardly therefrom such that first spaces are formed between adjacent ribs, the first plurality of upwardly-projecting ribs creating a pattern that is generally normal to the direction of the rim, the rim being adapted to be releasably lockable by fitting the first plurality of ribs and first spaces into respective second spaces and second plurality of ribs of a second container, the second spaces and the second plurality of ribs being shaped substantially the same as respective first spaces and first plurality of ribs.

55. The container of claim 54, wherein the first container is a bowl.

56. The container of claim 54, wherein the first container is a plate.

57. The container of claim 54, wherein the first container is made of polymeric material.

58. The container of claim 54, wherein the first plurality of upwardly-projecting ribs is generally perpendicular to the plane of the remainder of the respective rim.

59. The container of claim 58, wherein the first plurality of upwardly-projecting ribs is perpendicular to the plane of the remainder of the respective rim.

60. The container of claim 54, wherein the first plurality of upwardly-projecting ribs comprises first and second sidewalls and a surface that encompasses and bridges the first and second sidewalls, at least one of the first and second sidewalls has a first undercut.

61. The container of claim 54, wherein the first plurality of upwardly-projecting ribs creates a pattern that is normal to the direction of the rim.

62. The container of claim 54, wherein the first plurality of upwardly-projecting ribs includes at least about 3 ribs.

63. The container of claim 62, wherein the first plurality of upwardly-projecting ribs includes at least about 40 ribs.

64. A container to be used in a container assembly, comprising a continuous body portion and a rim, the rim encompassing and projecting laterally outwardly from the body portion, the rim having a first plurality of ribs projecting generally upwardly therefrom such that first spaces are formed between adjacent ribs, the first plurality of upwardly-projecting ribs creating a pattern that is generally normal to the direction of the rim, the rim being adapted to be releasably lockable by fitting the first plurality of ribs and first spaces into respective second spaces and second plurality of ribs of a second container, the second container being shaped substantially the same as the first container.

65. The container of claim 64, wherein the first container is a bowl.

66. The container of claim 64, wherein the first container is a plate.

67. The container of claim 64, wherein the first container is made of polymeric material.

68. The container of claim 64, wherein the first plurality of upwardly-projecting ribs is generally perpendicular to the plane of the remainder of the respective rim.

69. The container of claim 68, wherein the first plurality of upwardly-projecting ribs is perpendicular to the plane of the remainder of the respective rim.

70. The container of claim 64, wherein the first plurality of upwardly-projecting ribs comprises first and second sidewalls and a surface that encompasses and bridges the first and second sidewalls, at least one of the first and second sidewalls has first undercut.

71. The container of claim 64, wherein the first plurality of upwardly-projecting ribs creates a pattern that is normal to the direction of the rim.

72. The container of claim 64, wherein the first plurality of upwardly-projecting ribs includes at least about 3 ribs.

73. The container of claim 72, wherein the first plurality of upwardly-projecting ribs includes at least about 40 ribs.

74. A container assembly, comprising:

a first container including a first continuous body portion and a first rim, the first rim encompassing and projecting laterally outwardly from the first body portion, the rim having a first plurality of ribs projecting generally upwardly therefrom such that first spaces are formed between adjacent ribs, the first plurality of upwardly-projecting ribs creating a first pattern that is generally normal to the direction of the first rim; and a second container including a second continuous body portion and a second rim, the second rim encompassing and projecting laterally outwardly from the second body portion, the rim having a second plurality of ribs projecting generally upwardly therefrom such that second spaces are formed between adjacent ribs, the second plurality of upwardly-projecting ribs creating a second pattern that is generally normal to the direction of the second rim, the first container being shaped substantially the same as the second container, wherein the first container and the second container are adapted to be releasably lockable to each other by fitting the first plurality of upwardly-projecting ribs into respective second spaces and fitting the second plurality of upwardly-projecting ribs into respective first spaces, and wherein the first rim and the second rim are adapted to form a seal.

75. The container assembly of claim 74, wherein the first and second containers are bowls.

76. The container assembly of claim 74, wherein the first and second containers are plates.

77. The container assembly of claim 74, wherein the first container is a bowl and the second container is a plate.

78. The container assembly of claim 74, wherein the first and second containers are made of a mineral-filled polymeric material.

79. The container assembly of claim 74, wherein the first plurality of upwardly-projecting ribs comprises first and second sidewalls and a surface that encompasses and bridges the first and second sidewalls, at least one of the first and second sidewalls has a first undercut, and wherein the second plurality of upwardly-projecting ribs comprises third and fourth sidewalls and a surface that encompasses and bridges the third and fourth sidewalls, at least one of the third and fourth sidewalls has a second undercut.

80. The container assembly of claim 74, wherein the seal is located outwardly from the first plurality of upwardly-projecting ribs and the second plurality of upwardly-projecting ribs.

81. The container assembly of claim 46, wherein the first plurality of upwardly-projecting ribs creates a first pattern that is normal to the direction of the first rim and the second plurality of upwardly-projecting ribs creates a second pattern that is normal to the direction of the second rim.

82. The container assembly of claim 74, wherein the first plurality of upwardly-projecting ribs creates a first pattern that is normal to the direction of the first rim and the second plurality of upwardly-projecting ribs creates a second pattern that is normal to the direction of the second rim.

83. A container assembly, comprising:

a first container including a first continuous body portion and a first rim, the first rim encompassing and projecting laterally outwardly from the first body portion, the rim having a first plurality of ribs projecting generally upwardly therefrom such that first spaces are formed between adjacent ribs, the first plurality of upwardly-projecting ribs creating a first pattern that is generally normal to the direction of the first rim, the first plurality of upwardly-projecting ribs having at least one undercut; and a second container including a second continuous body portion and a second rim, the second rim encompassing and projecting laterally outwardly from the second body portion, the second rim having a second plurality of ribs projecting generally upwardly therefrom such that second spaces are formed between adjacent ribs, the second plurality of upwardly-projecting ribs creating a second pattern that is generally normal to the direction of the second rim, the second plurality of upwardly-projecting ribs having at least one undercut, the first container being shaped substantially the same as the second container, wherein the first container and the second container are adapted to be releasably lockable to each other by fitting the first plurality of upwardly-projecting ribs into respective second spaces and fitting the second plurality of upwardly-projecting ribs into respective first spaces.

84. The container assembly of claim 83, wherein the first and second containers are bowls.

85. The container assembly of claim 83, wherein the first and second containers are plates.

86. The container assembly of claim 83, wherein the first and second containers are made of polymeric material.

87. The container assembly of claim 86, wherein the first and second containers include a high-impact polystyrene.

88. The container assembly of claim 83, wherein the first container is identical to the second container.

89. The container assembly of claim 83, wherein the first plurality of upwardly-projecting ribs creates a first pattern that is normal to the direction of the first rim, and the second plurality of upwardly-projecting ribs creates a second pattern that is normal to the direction of the second rim.

90. The container assembly of claim 83, wherein the first rim and the second rim are adapted to form a seal.

91. The container assembly of claim 83, wherein each of the first plurality of upwardly-projecting ribs includes two undercuts and each of the second plurality of upwardly-projecting ribs includes two undercuts.

92. A container assembly, comprising:

a first container including a first continuous body portion and a first rim, the first rim encompassing and projecting laterally outwardly from the first body portion, the rim having a first plurality of ribs projecting generally upwardly therefrom such that first spaces are formed between adjacent ribs, the first plurality of upwardly-projecting ribs creating a first pattern that is generally normal to the direction of the first rim, the first plurality of upwardly-projecting ribs having at least one undercut; and a second container including a second continuous body portion and a second rim, the second rim encompassing and projecting laterally outwardly from the second body portion, the second rim having a second plurality of ribs projecting generally upwardly therefrom such that second spaces are formed between adjacent ribs, the second plurality of upwardly-projecting ribs creating a second pattern that is generally normal to the direction of the second rim, the second plurality of upwardly-projecting ribs having at least one undercut, the second rim and the first rim being shaped substantially the same, wherein the first container and the second container are adapted to be releasably lockable to each other by fitting the first plurality of upwardly-projecting ribs into respective second spaces and fitting the second plurality of upwardly-projecting ribs into respective first spaces.

93. The container assembly of claim 92, wherein the first and second containers are bowls.

94. The container assembly claim 92, wherein the first and second containers are plates.

95. The container assembly of claim 92, wherein the first and second containers are made of polymeric material.

96. The container assembly of claim 95, wherein the first and second containers include a high-impact polystyrene.

97. The container assembly of claim 92, wherein the first rim is identical to the second rim.

98. The container assembly of claim 92, wherein the first plurality of upwardly-projecting ribs creates a first pattern that is normal to the direction of the first rim, and the second plurality of upwardly-projecting ribs creates a second pattern that is normal to the direction of the second rim.

99. The container assembly of claim 92, wherein the first rim and the second rim are adapted to form a seal.

100. The container assembly of claim 92, wherein each of the first plurality of upwardly-projecting ribs includes two undercuts and each of the second plurality of upwardly-projecting ribs includes two undercuts.

101. A container assembly, comprising:

a first container including a first continuous body portion and a first rim, the first rim encompassing and projecting laterally outwardly from the first body portion, the rim having a first plurality of upwardly-projecting features with first spaces being formed between adjacent upwardly-projecting features, the first plurality of upwardly-projecting features creating a first pattern that is generally normal to the direction of the first rim, the first plurality of upwardly-projecting ribs having at least one undercut; and a second container including a second continuous body portion and a second rim, the second rim encompassing and projecting laterally outwardly from the second body portion, the second rim having a second plurality of upwardly-projecting features with second spaces being formed between adjacent upwardly-projecting features, the second plurality of upwardly-projecting features creating a second pattern that is generally normal to the direction of the second rim, the second plurality of upwardly-projecting ribs having at least one undercut, the second rim and the first rim being shaped substantially the same, wherein the first container and the second container are adapted to be releasably lockable to each other by fitting the first plurality of upwardly-projecting features into respective second spaces and fitting the second plurality of upwardly-projecting features into respective first spaces.

102. The container assembly of claim 101, wherein the first container and the second container arc identical.

103. The container assembly of claim 101, wherein the first and second rim are identical.

104. The container assembly of claim 101, wherein the first and second containers are made of polymeric material.

105. The container assembly of claim 104, wherein the first and second containers include a high-impact polystyrene.

106. The container assembly of claim 101, wherein the first rim and the second rim are adapted to form a seal.

107. The container assembly of claim 101, wherein each of the first plurality of upwardly-projecting ribs includes two undercuts and each of the second plurality of upwardly-projecting ribs includes two undercuts.

108. A container to be used in a container assembly, comprising a continuous body portion and a rim, the rim encompassing and projecting laterally outwardly from the body portion, the rim having a first plurality of ribs projecting generally upwardly therefrom such that first spaces are formed between adjacent ribs, the first plurality of upwardly-projecting ribs creating a pattern that is generally normal to the direction of the rim, the first plurality of upwardly-projecting ribs having at least one undercut, the rim being adapted to be releasably lockable by fitting the first plurality of ribs and first spaces into respective second spaces and second plurality of ribs of a second container, the second spaces and the second plurality of ribs being shaped substantially the same as respective first spaces and first plurality of ribs.

109. The container of claim 108, wherein the first container is a bowl.

110. The container of claim 108, wherein the first container is a plate.

111. The container of claim 108, wherein the first container is made of polymeric material.

112. The container of claim 111, wherein the first container includes a high-impact polystyrene.

113. The container of claim 108, wherein the first plurality of upwardly-projecting ribs creates a first pattern that is normal to the direction of the rim.

114. The container of claim 108, wherein each of the first plurality of upwardly-projecting ribs includes two undercuts.

115. A container to be used in a container assembly, comprising a continuous body portion and a rim, the rim encompassing and projecting laterally outwardly from the body portion, the rim having a first plurality of ribs projecting generally upwardly therefrom such that first spaces are formed between adjacent ribs, the first plurality of upwardly-projecting ribs creating a pattern that is generally normal to the direction of the rim, the first plurality of upwardly-projecting ribs having at least one undercut, the rim being adapted to be releasably lockable by fitting the first plurality of ribs and first spaces into respective second spaces and second plurality of ribs of a second container, the second container being shaped substantially the same as the first container.

116. The container of claim 115, wherein the first container is a bowl.

117. The container of claim 115, wherein the first container is a plate.

118. The container of claim 115, wherein the first container is made of polymeric material.

119. The container of claim 118, wherein the first container includes high-impact polystyrene.

120. The container of claim 115, wherein the first plurality of upwardly-projecting ribs creates a first pattern that is normal to the direction of the rim.

121. The container of claim 115, wherein each of the first plurality of upwardly-projecting ribs includes two undercuts.

* * * * *

UNITED STATES PATENT AND TRADEMARK OFFICE

CERTIFICATE OF CORRECTION

PATENT NO. : 6,886,704 B2
DATED : May 3, 2005
INVENTOR(S) : Thomas J. Hayes et al.

It is certified that error appears in the above-identified patent and that said Letters Patent is hereby corrected as shown below:

Column 13,
Line 17, replace the word "part" with the word -- apart --.
Lines 30-35, claim 14 should be deleted.
Line 36, claim 15 should be renumbered claim 14.
Lines 41-45, claim 16 should be deleted.
Line 46, claim 17 should be renumbered claim 15.
Line 50, claim 18 should be renumbered claim 16, dependent on claim 15.
Line 54, claim 19 should be renumbered claim 17.
Line 56, claim 20 should be renumbered claim 18, dependent on claim 17.
Line 60, claim 21 should be renumbered claim 19, dependent on claim 17.
Lines 64-67, claim 22 should be deleted.

Column 14,
Line 1, claim 23 should be renumbered claim 20.
Line 3, claim 24 should be renumbered claim 21.
Line 28, claim 25 should be renumbered claim 22, dependent on claim 21.
Line 30, claim 26 should be renumbered claim 23, dependent on claim 21.
Line 32, claim 27 should be renumbered claim 24, dependent on claim 21.
Line 34, claim 28 should be renumbered claim 25, dependent on claim 21.
Line 36, claim 29 should be renumbered claim 26, dependent on claim 21.
Line 38, claim 30 should be renumbered claim 27, dependent on claim 26.
Line 41, claim 31 should be renumbered claim 28, dependent on claim 21.
Line 43, claim 32 should be renumbered claim 29, dependent on claim 21.
Line 45, claim 33 should be renumbered claim 30, dependent on claim 21.
Line 49, claim 34 should be renumbered claim 31, dependent on claim 30.
Line 53, claim 35 should be renumbered claim 32, dependent on claim 21.
Line 64, claim 36 should be renumbered claim 33, dependent on claim 21.

Column 15,
Lines 6-11, claim 37 should be deleted.
Line 12, claim 38 should be renumbered claim 34, dependent on claim 21.
Line 17, claim 39 should be renumbered claim 35, dependent on claim 21.
Line 21, claim 40 should be renumbered claim 36, dependent on claim 35.
Line 24, claim 41 should be renumbered claim 37, dependent on claim 21.
Line 27, claim 42 should be renumbered claim 38, dependent on claim 37.
Line 31, claim 43 should be renumbered claim 39, dependent on claim 37.
Lines 35-38, claim 44 should be deleted.
Line 39, claim 45 should be renumbered claim 40, dependent on claim 21.
Line 41, claim 46 should be renumbered claim 41.

UNITED STATES PATENT AND TRADEMARK OFFICE

CERTIFICATE OF CORRECTION

PATENT NO. : 6,886,704 B2
DATED : May 3, 2005
INVENTOR(S) : Thomas J. Hayes et al.

It is certified that error appears in the above-identified patent and that said Letters Patent is hereby corrected as shown below:

Column 16,
Line 1, claim 47 should be renumbered claim 42, dependent on claim 41.
Line 4, claim 48 should be renumbered claim 43, dependent on claim 42.
Line 6, claim 49 should be renumbered claim 44, dependent on claim 41.
Line 8, claim 50 should be renumbered claim 45, dependent on claim 41.
Line 10, claim 51 should be renumbered claim 46, dependent on claim 41.
Line 12, claim 52 should be renumbered claim 47, dependent on claim 46.
Line 15, claim 53 should be renumbered claim 48, dependent on claim, 46.
Line 19, claim 54 should be renumbered claim 49.
Line 32, claim 55 should be renumbered claim 50, dependent on claim 49.
Line 34, claim 56 should be renumbered claim 51, dependent on claim 49.
Line 36, claim 57 should be renumbered claim 52, dependent on claim 49.
Line 38, claim 58 should be renumbered claim 53, dependent on claim 49.
Line 41, claim 59 should be renumbered claim 54, dependent on claim 53.
Line 44, claim 60 should be renumbered claim 55, dependent on claim 49.
Line 49, claim 61 should be renumbered claim 56, dependent on claim 49.
Line 52, claim 62 should be renumbered claim 57, dependent on claim 49.
Line 54, claim 63 should be renumbered claim 58, dependent on claim 57.
Line 56, claim 64 should be renumbered claim 59.

Column 17,
Line 1, claim 65 should be renumbered claim 60, dependent on claim 59.
Line 3, claim 66 should be renumbered claim 61, dependent on claim 59.
Line 5, claim 67 should be renumbered claim 62, dependent on claim 59.
Line 7, claim 68 should be renumbered claim 63, dependent on claim 59.
Line 9, claim 69 should be renumbered claim 64, dependent on claim 63.
Line 13, claim 70 should be renumbered claim 65, dependent on claim 59.
Line 17, claim 71 should be renumbered claim 66, dependent on claim 59.
Line 20, claim 72 should be renumbered claim 67, dependent on claim 59.
Line 22, claim 73 should be renumbered claim 68, dependent on claim 67.
Line 24, claim 74 should be renumbered claim 69.
Line 50, claim 75 should be renumbered claim 70, dependent on claim 69.
Line 52, claim 76 should be renumbered claim 71, dependent on claim 69.
Line 54, claim 77 should be renumbered claim 72, dependent on claim 69.
Line 56, claim 78 should be renumbered claim 73, dependent on claim 69.
Line 59, claim 79 should be renumbered claim 74, dependent on claim 69.

UNITED STATES PATENT AND TRADEMARK OFFICE

CERTIFICATE OF CORRECTION

PATENT NO. : 6,886,704 B2
DATED : May 3, 2005
INVENTOR(S) : Thomas J. Hayes et al.

It is certified that error appears in the above-identified patent and that said Letters Patent is hereby corrected as shown below:

Column 18,
Line 1, claim 80 should be renumbered claim 75, dependent on claim 69.
Line 5, claim 81 should be renumbered claim 76, dependent on claim 41.
Line 10, claim 82 should be renumbered claim 77, dependent on claim 69.
Line 15, claim 83 should be renumbered claim 78.
Line 44, claim 84 should be renumbered claim 79, dependent on claim 78.
Line 46, claim 85 should be renumbered claim 80, dependent on claim 78.
Line 48, claim 86 should be renumbered claim 81, dependent on claim 78.
Line 50, claim 87 should be renumbered claim 82, dependent on claim 81.
Line 52, claim 88 should be renumbered claim 83, dependent on claim 78.
Line 54, claim 89 should be renumbered claim 84, dependent on claim 78.
Line 59, claim 90 should be renumbered claim 85, dependent on claim 78.
Line 61, claim 91 should be renumbered claim 86, dependent on claim 78.
Line 65, claim 92 should be renumbered claim 87.

Column 19,
Line 27, claim 93 should be renumbered claim 88, dependent on claim 87.
Line 29, claim 94 should be renumbered claim 89, dependent on claim 87.
Line 31, claim 95 should be renumbered claim 90, dependent on claim 87.
Line 33, claim 96 should be renumbered claim 91, dependent on claim 90.
Line 35, claim 97 should be renumbered claim 92, dependent on claim 87.
Line 37, claim 98 should be renumbered claim 93, dependent on claim 87.
Line 42, claim 99 should be renumbered claim 94, dependent on claim 87.
Line 44, claim 100 should be renumbered claim 95, dependent on claim 87.
Line 48, claim 101 should be renumbered claim 96.

Column 20,
Line 10, claim 102 should be renumbered claim 97, dependent on claim 96.
Line 11, please replace the word "arc" with the word -- are --.
Line 12, claim 103 should be renumbered claim 98, dependent on claim 96.
Line 14, claim 104 should be renumbered claim 99, dependent on claim 96.
Line 16, claim 105 should be renumbered claim 100, dependent on claim 99.
Line 19, claim 106 should be renumbered claim 101, dependent on claim 96.
Line 21, claim 107 should be renumbered claim 102, dependent on claim 96.
Line 25, claim 108 should be renumbered claim 103.
Line 40, claim 109 should be renumbered claim 104, dependent on claim 103.
Line 42, claim 110 should be renumbered claim 105, dependent on claim 103.
Line 44, claim 111 should be renumbered claim 106, dependent on claim 103.
Line 46, claim 112 should be renumbered claim 107, dependent on claim 106.

UNITED STATES PATENT AND TRADEMARK OFFICE

CERTIFICATE OF CORRECTION

PATENT NO. : 6,886,704 B2
DATED : May 3, 2005
INVENTOR(S) : Thomas J. Hayes et al.

It is certified that error appears in the above-identified patent and that said Letters Patent is hereby corrected as shown below:

Column 20 (cont'd),
Line 48, claim 113 should be renumbered claim 108, dependent on claim 103.
Line 51, claim 114 should be renumbered claim 109, dependent on claim 103.
Line 54, claim 115 should be renumbered claim 110.

Column 21,
Line 1, claim 116 should be renumbered claim 111, dependent on claim 110.
Line 3, claim 117 should be renumbered claim 112, dependent on claim 110.
Line 5, claim 118 should be renumbered claim 113, dependent on claim 110.
Line 7, claim 119 should be renumbered claim 114, dependent on claim 113.

Column 22,
Line 1, claim 120 should be renumbered claim 115, dependent on claim 110.
Line 4, claim 121 should be renumbered claim 116, dependent on claim 110.

Signed and Sealed this

Sixth Day of September, 2005

JON W. DUDAS
*Director of the United States Patent and Trademark Office*